US010240371B2

(12) United States Patent
Witchey

(10) Patent No.: US 10,240,371 B2
(45) Date of Patent: Mar. 26, 2019

(54) ROLLING DOOR LOCK

(71) Applicant: Bryan Witchey, Cross Junction, VA (US)

(72) Inventor: Bryan Witchey, Cross Junction, VA (US)

( * ) Notice: Subject to any disclaimer, the term of this patent is extended or adjusted under 35 U.S.C. 154(b) by 139 days.

(21) Appl. No.: 15/207,491

(22) Filed: Jul. 11, 2016

(65) Prior Publication Data

US 2018/0010369 A1 Jan. 11, 2018

(51) Int. Cl.

| | |
|---|---|
| ***E05B 83/04*** | (2014.01) |
| ***E05B 65/00*** | (2006.01) |
| ***E05B 17/20*** | (2006.01) |
| ***E05B 13/00*** | (2006.01) |
| ***E05B 67/38*** | (2006.01) |
| ***E05C 19/18*** | (2006.01) |

(52) U.S. Cl.

CPC ..... *E05B 83/04* (2013.01); *E05B 13/001* (2013.01); *E05B 13/002* (2013.01); *E05B 17/2084* (2013.01); *E05B 65/0021* (2013.01); *E05B 67/38* (2013.01); *E05B 67/383* (2013.01); *E05C 19/18* (2013.01)

(58) Field of Classification Search

CPC .. E05B 13/001; E05B 13/002; E05B 17/2084; E05B 17/2088; E05B 17/2092; E05B 67/38; E05B 77/44; E05B 83/04; E05B 83/06; E05B 83/12; E05B 65/0007; E05B 65/0021; E05B 65/08; E05B 65/0811; E05B 65/0888; E05B 65/0894

See application file for complete search history.

(56) References Cited

U.S. PATENT DOCUMENTS

| | | | | |
|---|---|---|---|---|
| 2,352,190 | A * | 6/1944 | Foote | E05B 67/22 29/437 |
| 5,737,946 | A * | 4/1998 | Sole | E05B 13/001 292/104 |
| 5,839,301 | A * | 11/1998 | Hsu | E05B 37/025 70/25 |
| 6,173,590 | B1 | 1/2001 | Witchey | |
| 6,519,983 | B2 | 2/2003 | Witchey | |
| 6,539,757 | B2 | 4/2003 | Witchey | |
| 6,553,797 | B2 | 4/2003 | Witchey | |
| 6,698,256 | B2 | 3/2004 | Witchey | |
| 6,705,135 | B2 | 3/2004 | Witchey | |
| 6,990,838 | B2 | 1/2006 | Witchey | |
| 7,278,663 | B2 | 10/2007 | Witchey | |

(Continued)

*Primary Examiner* — Christopher J Boswell
(74) *Attorney, Agent, or Firm* — Griffin and Szipl PC

(57) ABSTRACT

A rolling door lock for a roll-up door, and more particularly a roll-up door that includes a latching handle assembly fitted to the exterior surface of a roll-up door. The latching handle assembly includes a handle and a hook. The rolling door lock attaches to the hook and handle of the latching handle assembly to prevent forced opening of the roll-up door. The rolling door lock includes a main body and a detachable bracket. The main body includes a hook securing portion and a pocket. The pocket includes a slot. During normal use the hook securing portion of the rolling door lock secures the hook of the latching handle assembly, and the detachable bracket secures the handle of the latching handle assembly. The lock mechanism locks the detachable bracket with the handle secured therein to the pocket.

20 Claims, 17 Drawing Sheets

(56) References Cited

U.S. PATENT DOCUMENTS

| | | | | |
|---|---|---|---|---|
| 7,874,188 | B2 * | 1/2011 | Chudzicki | E05B 13/002 292/DIG. 32 |
| 7,878,032 | B1 * | 2/2011 | Gogel | E05B 67/38 292/205 |
| 8,833,114 | B2 * | 9/2014 | Szczygielski | E05B 65/0021 70/203 |
| 9,562,374 | B1 * | 2/2017 | Haber | E05B 83/14 |
| 2002/0104336 | A1 | 8/2002 | Witchey | |
| 2002/0104340 | A1 | 8/2002 | Witchey | |
| 2002/0104342 | A1 | 8/2002 | Witchey | |
| 2003/0167805 | A1 | 9/2003 | Witchey | |
| 2003/0167806 | A1 | 9/2003 | Witchey | |
| 2003/0167807 | A1 | 9/2003 | Witchey | |
| 2004/0200246 | A1 | 10/2004 | Witchey | |
| 2005/0099018 | A1 | 5/2005 | Witchey | |
| 2011/0316291 | A1 * | 12/2011 | Loughlin | E05B 13/001 292/101 |
| 2012/0103032 | A1 * | 5/2012 | Thomsen | E05B 13/002 70/14 |

* cited by examiner

| Table 1 | |
|---|---|
| 100 | rolling door lock 100 |
| 120 | latching handle assembly 120 |
| 125 | handle 125 of latching handle assembly 120 |
| 127 | end 127 of handle 125 |
| 130 | hook 130 of latching handle assembly 120 |
| 140 | exterior surface 140 of roll-up door 160 |
| 160 | roll-up door 160 |
| 180 | main body 180 |
| 200 | detachable bracket 200 |
| 220 | opposite first 220 and second 240 ends |
| 240 | opposite first 220 and second 240 ends |
| 260 | hook securing portion 260 of main body 180 |
| 280 | pocket 280 |
| 282a, 282b, 282c, 282d | pocket sidewalls 282a, 282b, 282c, and 282d |
| 285 | slot 285 |
| 290 | longitudinal axis 290 of the hook securing portion 260 |
| 300 | lock mechanism 300 |
| 305 | lock housing 305 |
| 320c | combination lock 320c |
| 320b | barrel shaped spring lock 320b |
| 320k | key operated lock 320k |
| 330 | spring-loaded lock mechanism 330 |
| 339a, 339b | slot holes 339a and 339b |
| 340a, 340b | first 340a and second 340b opposite sidewalls of detachable bracket 200 |
| 342a, 342b | first 342a edge and second 342b edge of detachable bracket 200 |
| 344 | exterior surface 344 of first sidewall 340a of bracket 200 |
| 346 | plurality of holes 346 |
| 347 | hole 347 |
| 348 | row of holes 348 in the first sidewall 340a of detachable bracket 200 |
| 350 | extension 350, which is integral with the outer surface 344 of the first wall 340a, is located above the row of holes 348 |
| 354 | recess 354 in the bottom edge surface 352 |
| 356 | channel 356 in the bottom edge surface 352 |
| 358 | lower portion 358 of the first side 340a of bracket 200 |
| 360 | top 360 of slot 285 |

*FIG. 13A*

| Table 1 (continued) | |
|---|---|
| 362, 364 | slot 285 is defined by an inner slot sidewall 362 and an outer slot sidewall 364 |
| 366 | exterior surface 366 of outer slot sidewall 364 |
| 368 | padlock 368 |
| 420 | L-shaped bracket 420 |
| 440, 460 | first 440 and second 460 sidewalls of L-shaped bracket 420 |
| 480 | base plate 480 of L-shaped bracket 420 |
| 490 | securing member 490 |
| 495 | securing hole 495 |
| 498 | optional blind hole 498 |
| 500 | tongue 500 |
| 520 | spring 520 |
| 560 | lock hook 560 |
| 570 | combination lock housing 570 |
| 580 | gap 580 is located between the base plate 480 and the second sidewall 460 of bracket 420n |
| 600 | base plate hole 600 of the base plate 480 |
| 620 | end 620 of the lock hook 560 |
| 640 | spring end 640 |
| 660 | spring end 660 |

*FIG. 13B*

ROLLING DOOR LOCK

STATEMENT REGARDING FEDERALLY SPONSORED RESEARCH OR DEVELOPMENT

Not Applicable.

FIELD OF THE INVENTION

The present invention relates generally to anti-theft devices. More specifically, the invention is a rolling door lock for securing a roll-up door, also referred to as a rolling door, such as, but not limited to, a roll-up door fitted to a cargo truck.

BACKGROUND OF THE INVENTION

Securing goods and cargo from theft and unwanted access is required for efficient transport and storage facilities. For example, cargo trucks are often fitted with a roll-up door. Roll-up doors are often fitted to public storage units to prevent unwanted access to the contents therein. Roll-up doors are often used in loading docks of buildings such as large retail stores, factories, and large office buildings.

Cargo trucks fitted with roll-up doors are vulnerable to cargo theft. Theft of cargo can occur, for example, anywhere along a supply chain including truck stops. Anyone who rents or otherwise makes use of a public storage unit, also referred to as a storage locker, protect their belongings by pulling down a roll-up door. Roll-up doors of storage units also need to be secured to avoid theft of contents stored therein. It should be understood that "roll-up doors" are also referred to as "rolling doors".

Roll-up doors are typically fitted with a latching handle assembly. A latching handle assembly helps to secure a roll-up door in a down position, for example, to prevent cargo falling out of a cargo truck. However, latching handle assemblies are designed to be easily opened by a truck operator. Padlocks are typically used to help prevent misuse of such latching handle assemblies. Padlocks offer some protection, but better locks are needed to prevent theft. Thus, there is a need for robust devices to secure latching handle assemblies fitted to roll-up doors.

SUMMARY OF THE INVENTION

A rolling door lock for securing a roll-up door. The roll-up door having a latching handle assembly fitted to an exterior surface of a roll-up door. The latching handle assembly being a conventional latching handle assembly as described, for example, in U.S. Pat. No. 5,063,764 (issued to Amis et al.). The latching handle assembly includes a handle and a hook. The latching handle assembly is sometimes referred to as a "J-hook" latching device. To prevent forced opening of the roll-up door the rolling door lock of the present invention is attached to the hook and handle of the latching handle assembly.

The rolling door lock of the present invention includes a main body and a detachable bracket. The main body has opposite first and second ends, a hook securing portion, and a pocket for receiving the detachable bracket. The pocket includes a slot. The hook securing portion forms the first end of the main body. The pocket (or slot) is located between the hook securing portion and the second end of the main body. A lock mechanism is attached to the pocket (or slot). The lock mechanism secures the detachable bracket to the pocket (or slot).

BRIEF DESCRIPTION OF THE DRAWINGS

FIGS. 13A and 13B shows Table 1.

Similar reference characters denote corresponding features consistently throughout the attached drawings.

DETAILED DESCRIPTION OF THE PREFERRED EMBODIMENTS

Figure 1A:
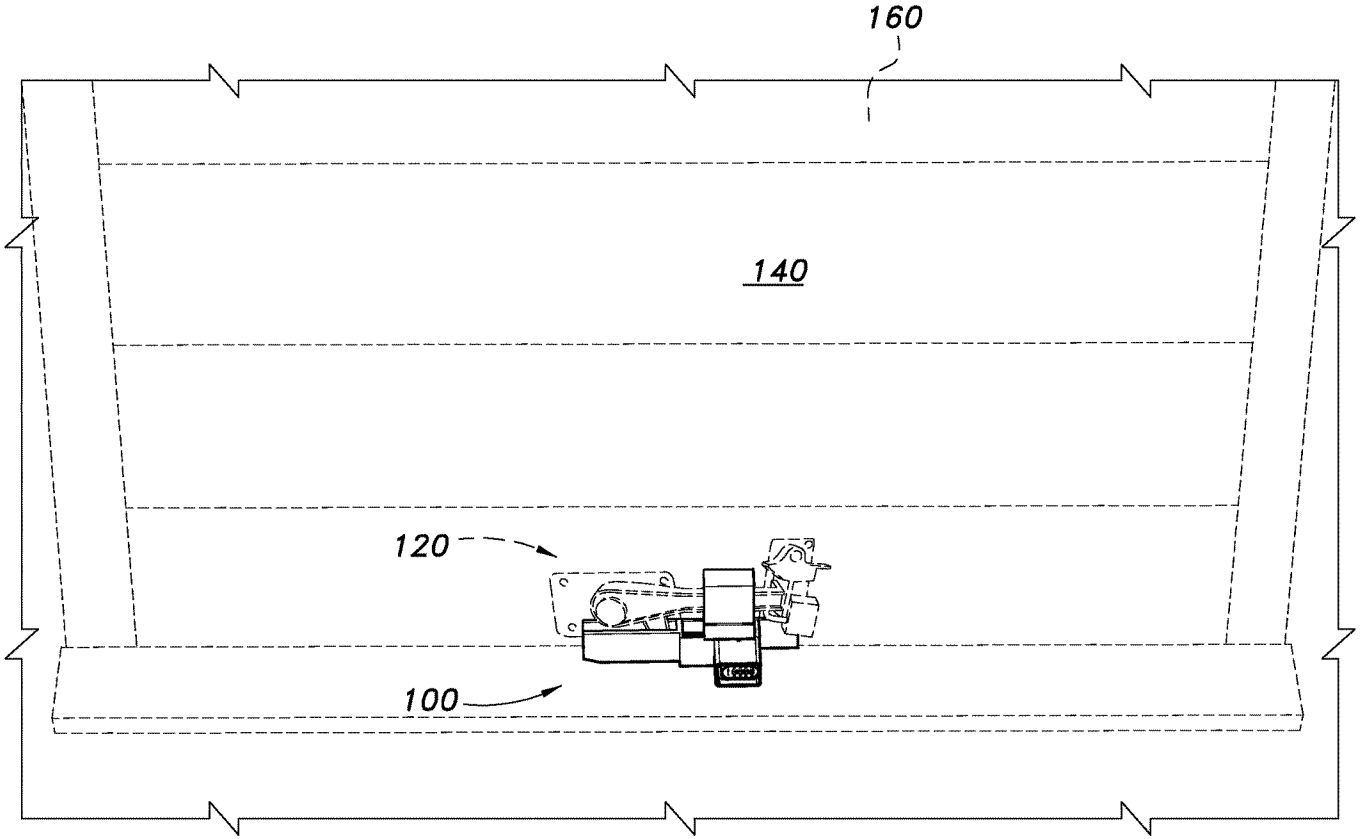
FIG. 1A shows a perspective environmental view of a rolling door lock according to the present invention.

The present invention is directed to an anti-theft device. More specifically, the invention is a rolling door lock 100 for a roll-up door 160 having a latching handle assembly 120 fitted to an exterior surface 140 of a roll-up door 160. The latching handle assembly 120 being a conventional latching handle assembly as described, for example, in U.S. Pat. No. 5,063,764 (issued to Amis et al.); U.S. Pat. No. 5,063,764 is incorporated herein by reference in its entirety. The latching handle assembly 120 includes a hook 130. The latching handle assembly is sometimes referred to as a "J-hook" latching device.

The rolling door lock 100 work by securing both the hook 130 and handle 125 of latching handle assembly 120 to prevent forced opening of a roll-up door 160. The rolling door lock 100 includes a main body 180 and a detachable handle securing bracket 200. The main body 180 secures the hook 130 of the latching handle assembly 120; and the handle securing bracket 200 secures the handle 125 of the latching handle assembly 120.

The main body 180 has opposite first 220 and second 240 ends, a hook securing portion 260, and a pocket (or slot) 280 for receiving the detachable handle securing bracket 200. The hook securing portion 260 forms the first end 220 of the main body 180. The hook securing portion 260 defines a longitudinal axis 290 (shown in FIG. 9). The pocket (or slot) 280 is located between the hook securing portion 260 and the second end 240 of the main body 180.

Figure 9:
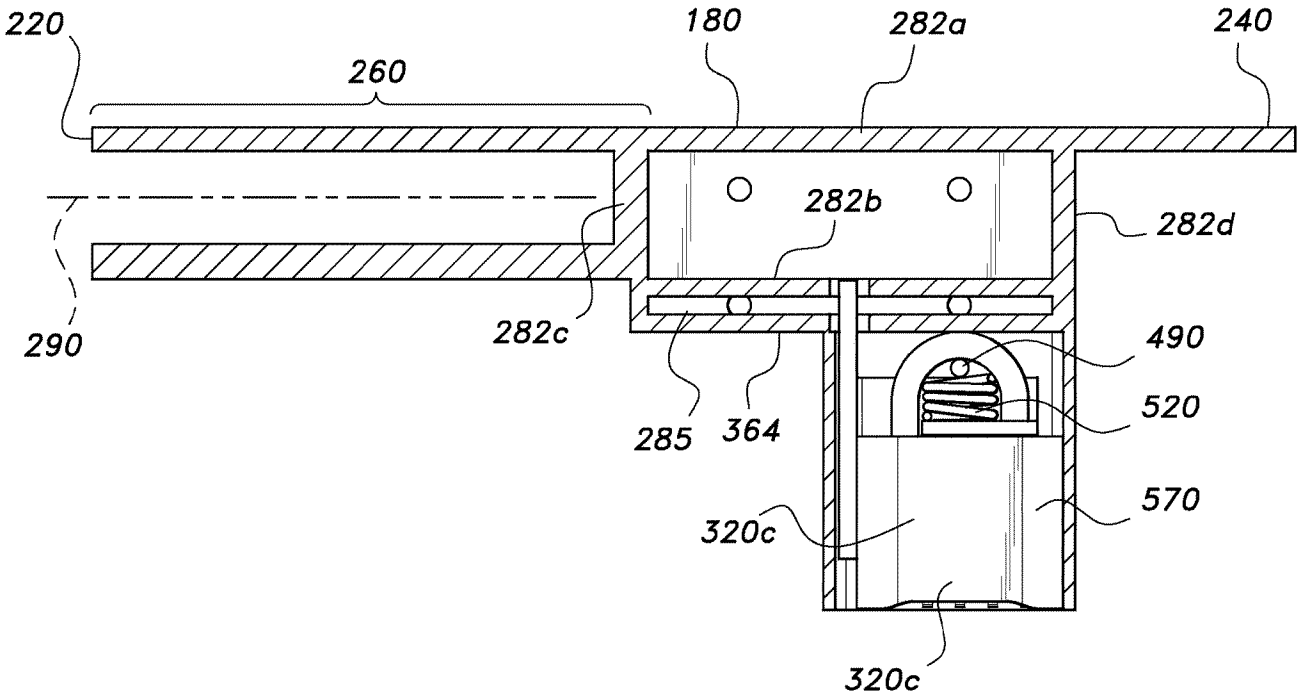
FIG. 9 is a section top view of the rolling door lock of FIG. 2A.

The pocket (or slot) 280 includes opposite facing first and second pocket (or slot) sidewalls 282*a* and 282*b*; and opposite facing third and second pocket (or slot) sidewalls 282*c* and 282*d* (see, for example, the section view shown in FIG. 9). The first and second pocket (or slot) sidewalls 282*a* and 282*b* are parallel to the longitudinal axis 290 of the hook securing portion 260. The third and second pocket (or slot) sidewalls 282*c* and 282*d* are perpendicular to the longitudinal axis 290.

The pocket (or slot) 280 includes a slot 285. The slot 285 is formed by the second pocket (or slot) sidewall 282*b* and an outer slot sidewall 364. The outer slot sidewall 364 defines an exterior surface 366. The second pocket (or slot) sidewall 282*b* and outer slot sidewall 364 are themselves opposite facing sidewalls such that the outer slot sidewall 364 is also parallel to the longitudinal axis 290.

A lock mechanism 300 is attached to the pocket (or slot) 280. The lock mechanism 300 secures the detachable handle securing bracket 200 to the pocket (or slot) 280. During actual use, the detachable handle securing bracket 200 is placed over a portion of the handle 125 and the bracket 200 with a portion of the handle 125 therein is secured to the pocket (or slot) 280 by the lock mechanism 300. The lock mechanism 300 is located inside lock housing 305.

Referring to the Figures in general, Table 1 (FIGS. 13A and 13B) is a useful point of reference when referring to the Figures.

Figure 1B:
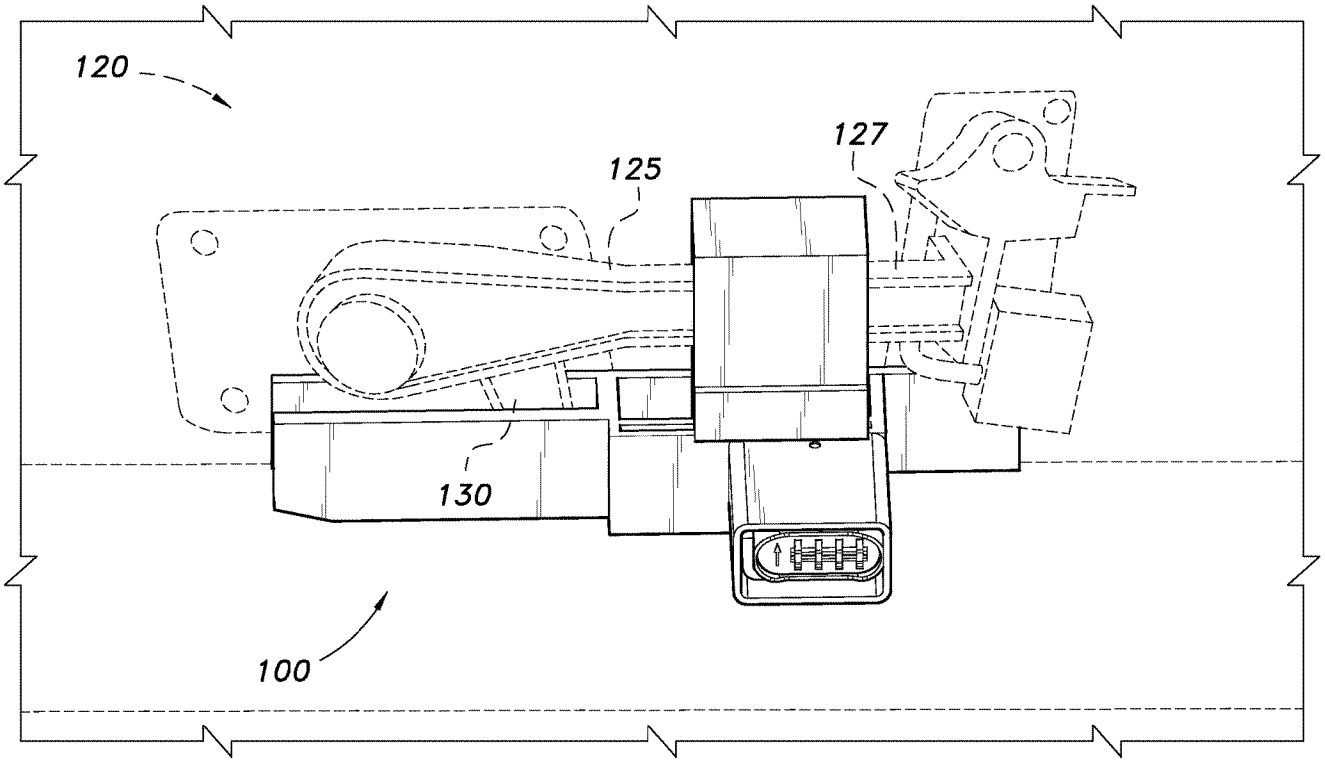
FIG. 1B is a close up view of the rolling door lock of FIG. 1A.

FIGS. 1A and 1B show perspective environmental views of a rolling door lock 100 according to the invention. The rolling door lock 100 is shown attached to latching handle assembly 120. Latching handle assembly 120 is shown attached to an outer surface 140 of a roll-up door 160.

The latching handle assembly 120 is a conventional latching handle assembly as described, for example, in U.S. Pat. No. 5,063,764 (issued to Amis et al.). For example, the latching handle assembly includes a handle 125 and a hook 130. The latching handle assembly 120 is sometimes referred to as a "J-hook" latching device. To prevent forced opening of a roll-up door 160, the rolling door lock 100 is attached by an operator, such as a truck driver, to the handle 125 and hook 130 of the latching handle assembly 120.

Figure 2A:
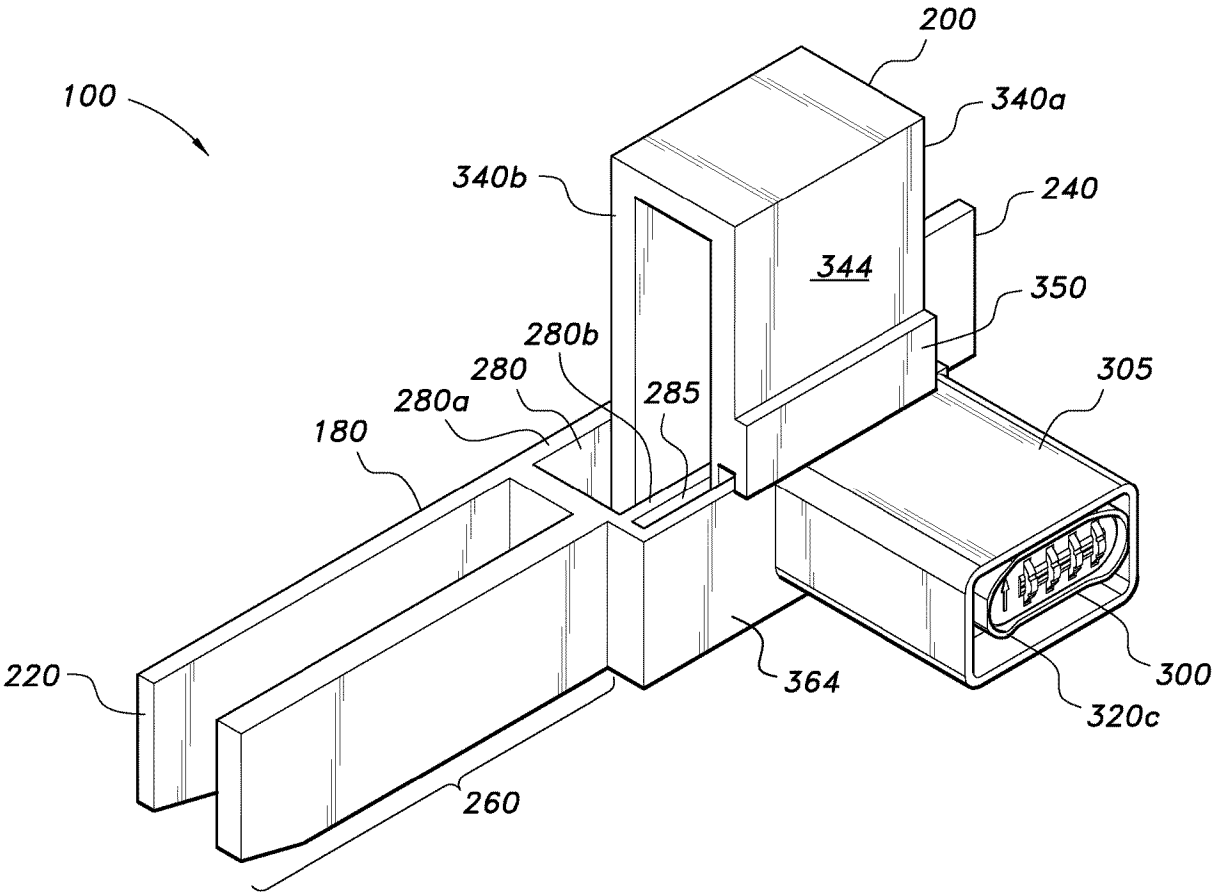
FIG. 2A is a perspective view of a rolling door lock fitted with a combination lock according to the present invention.

Referring to FIG. 2A, the rolling door lock of the present invention includes a main body 180 and a detachable bracket 200. The main body 180 has opposite first 220 and second 240 ends, a hook securing portion 260, and defines a pocket (or slot) 280 for receiving the detachable bracket 200. The pocket (or slot) 280 includes a slot 285 to accommodate a first sidewall 340*a* of the detachable bracket 200.

Still referring to FIG. 2A, the hook securing portion 260 forms the first end 220 of the main body. The pocket (or slot) 280 is located between the hook securing portion and the second end of the main body. A lock mechanism 300 is shown attached to the pocket (or slot) 280. The lock mechanism 300 is located inside lock housing 305. The lock mechanism 300 secures the detachable bracket 200 to the pocket (or slot) 280. The lock housing 305 while not in direct contact with the hook securing portion 260, the lock housing 305 is in the same plane as the hook securing portion 260 and extends at a perpendicular angle therefrom.

Figure 11:
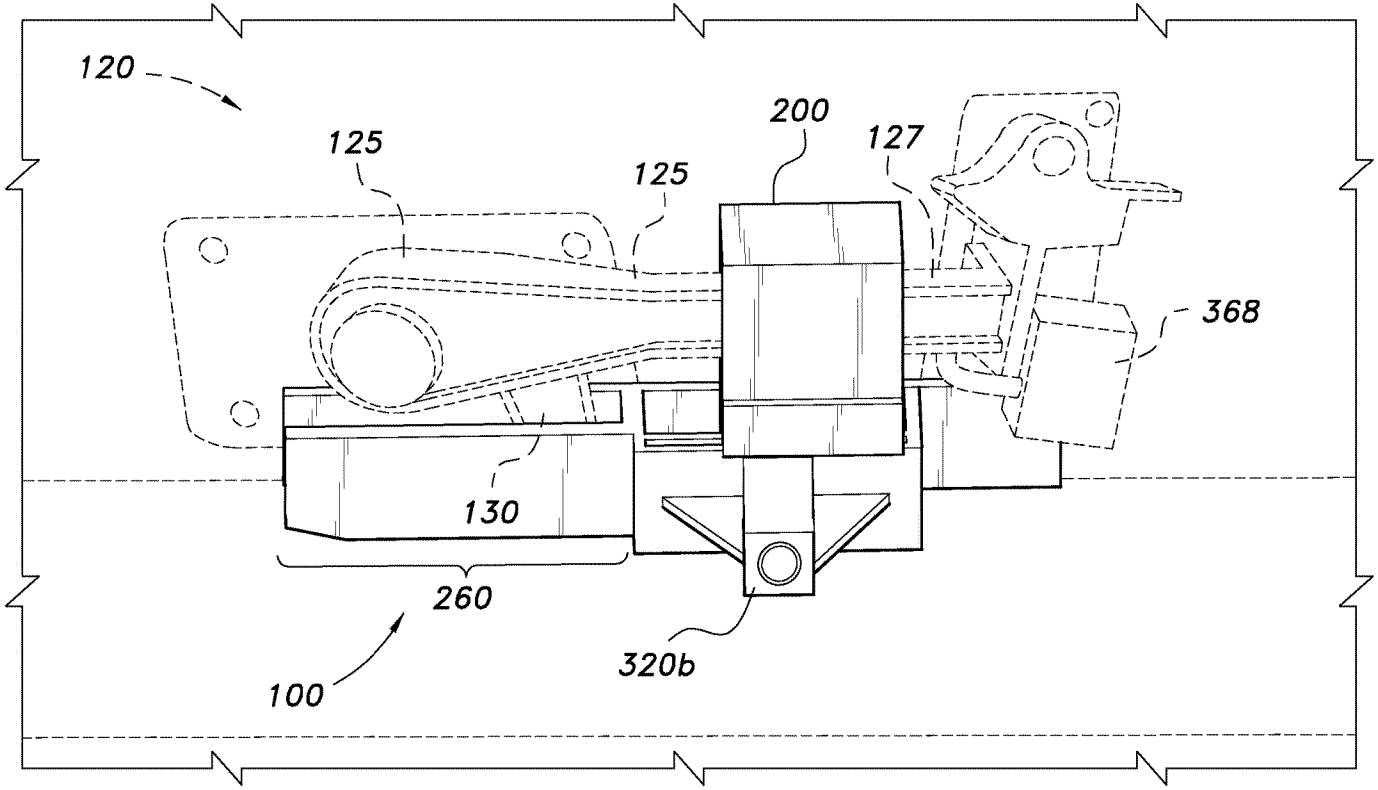
FIG. 11 is a perspective section view of the rolling door lock of FIG. 2A.

It should be understood that during normal use of the rolling door lock 100, the detachable bracket 200 is used to secure the handle 125 of latching handle assembly 120 (see FIG. 11). Also, the hook securing portion 260 of main body 180 secures the hook 130 of latching handle assembly 120 (see FIG. 11).

Figure 2B:
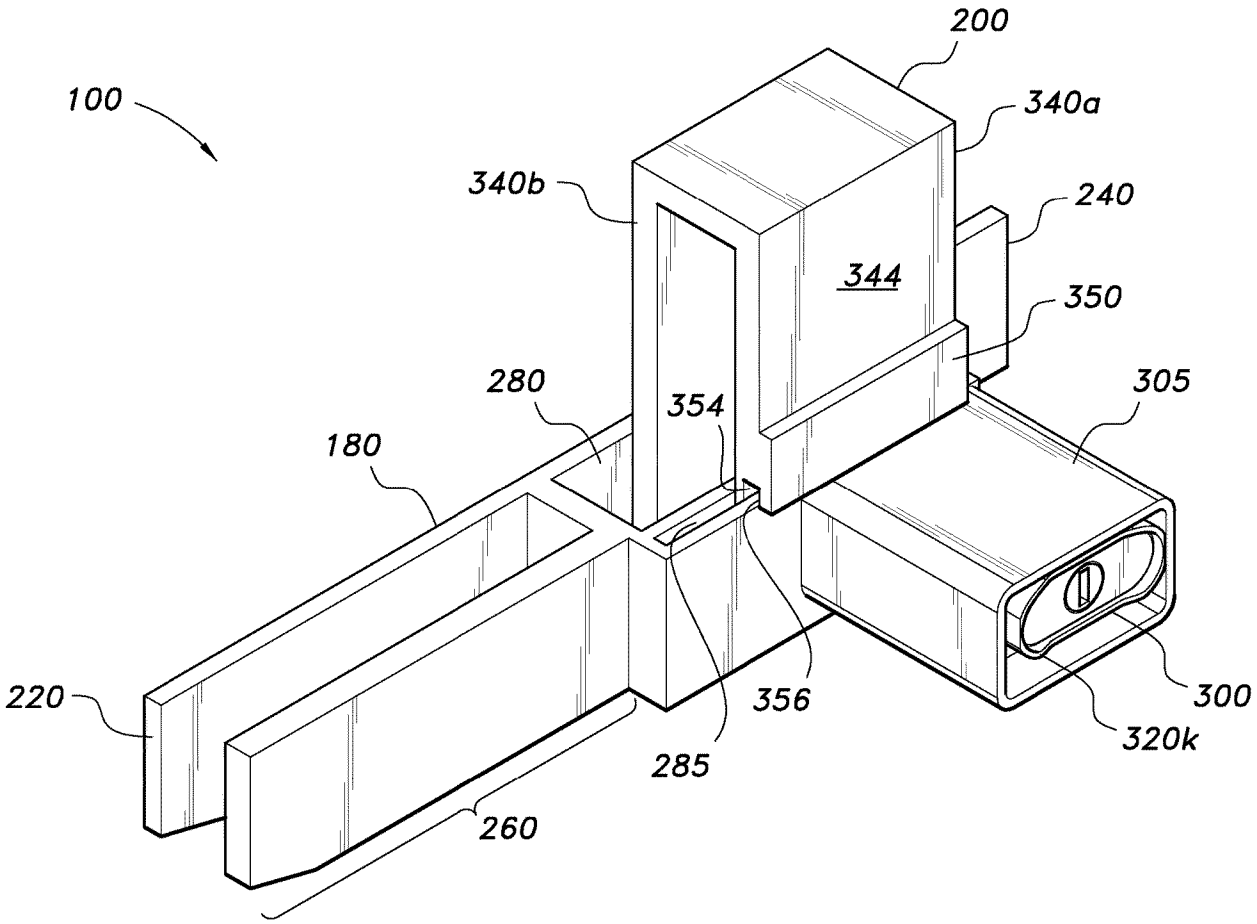
FIG. 2B is a perspective view of a rolling door lock fitted with a key operated lock according to the present invention.

It should also be understood that while the lock mechanism 300 shown in FIG. 2A comprises a combination lock 320*c*, the invention is not restricted to a particular kind of lock. For example, FIG. 2B shows a perspective view of a rolling door lock of FIG. 2A, but fitted with a key operated lock 320*k* in place of the combination lock 320*c*.

Figure 3:
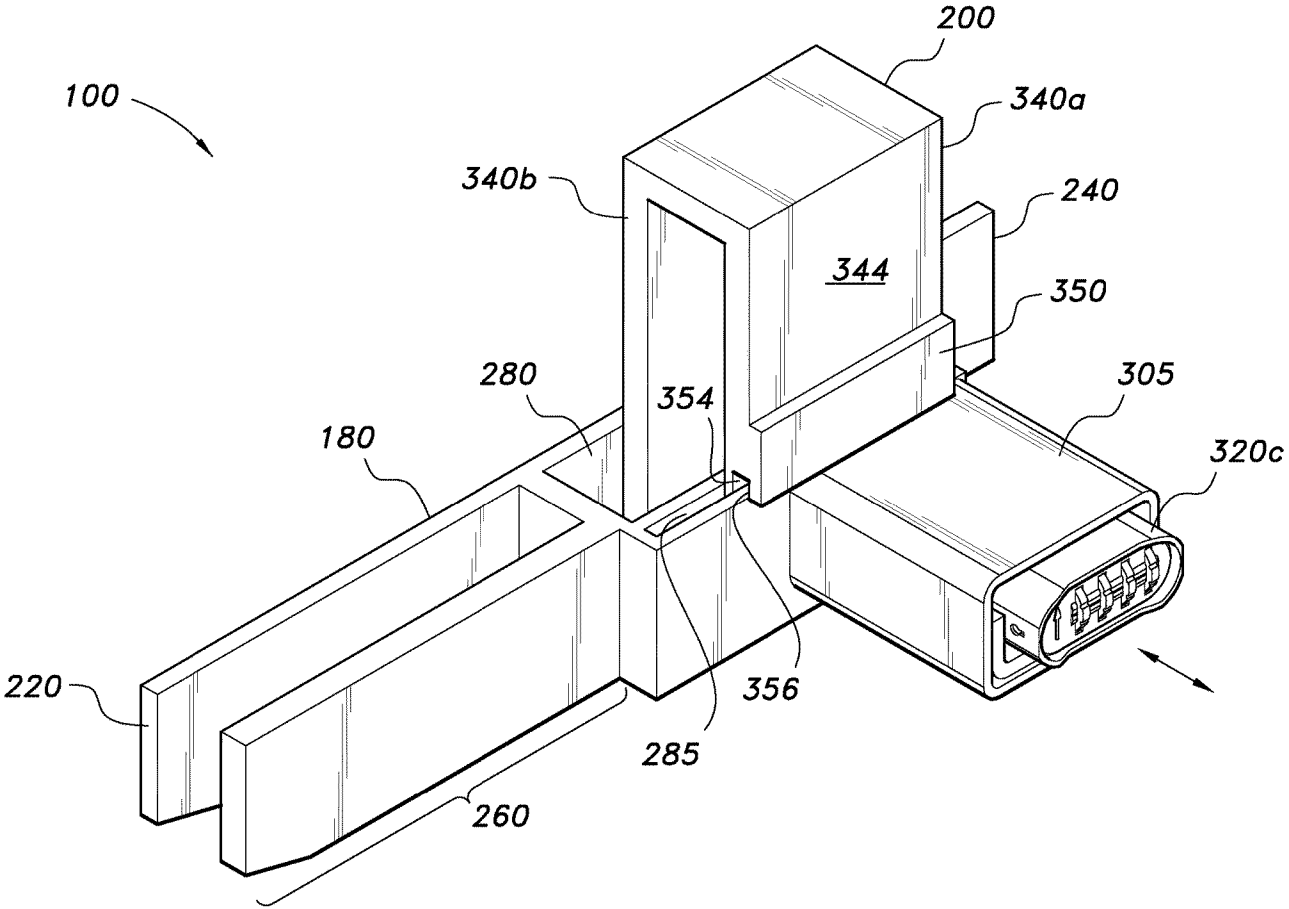
FIG. 3 shows another perspective view of the rolling door lock shown in FIG. 2A but with the combination lock in a partial popped-out position to facilitate resetting the combination number of the combination lock.

FIG. 3 shows another perspective view of the rolling door lock shown in FIG. 2A but with the combination lock 320*c* in a partial popped-out position to facilitate resetting the combination number of the combination lock 320*c*.

Figure 4A:
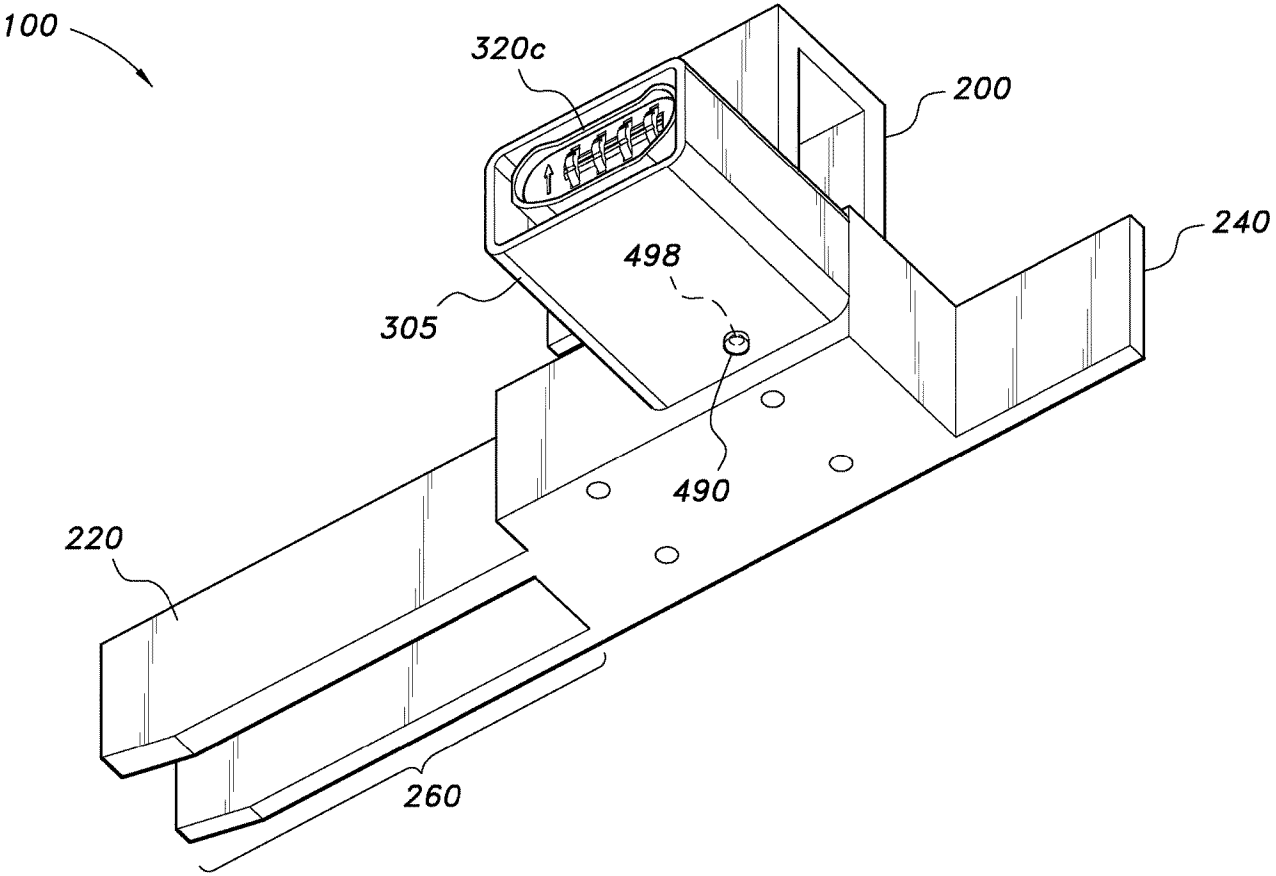
FIG. 4A is a perspective bottom view of the rolling door lock shown in FIG. 2A.
Figure 4B:
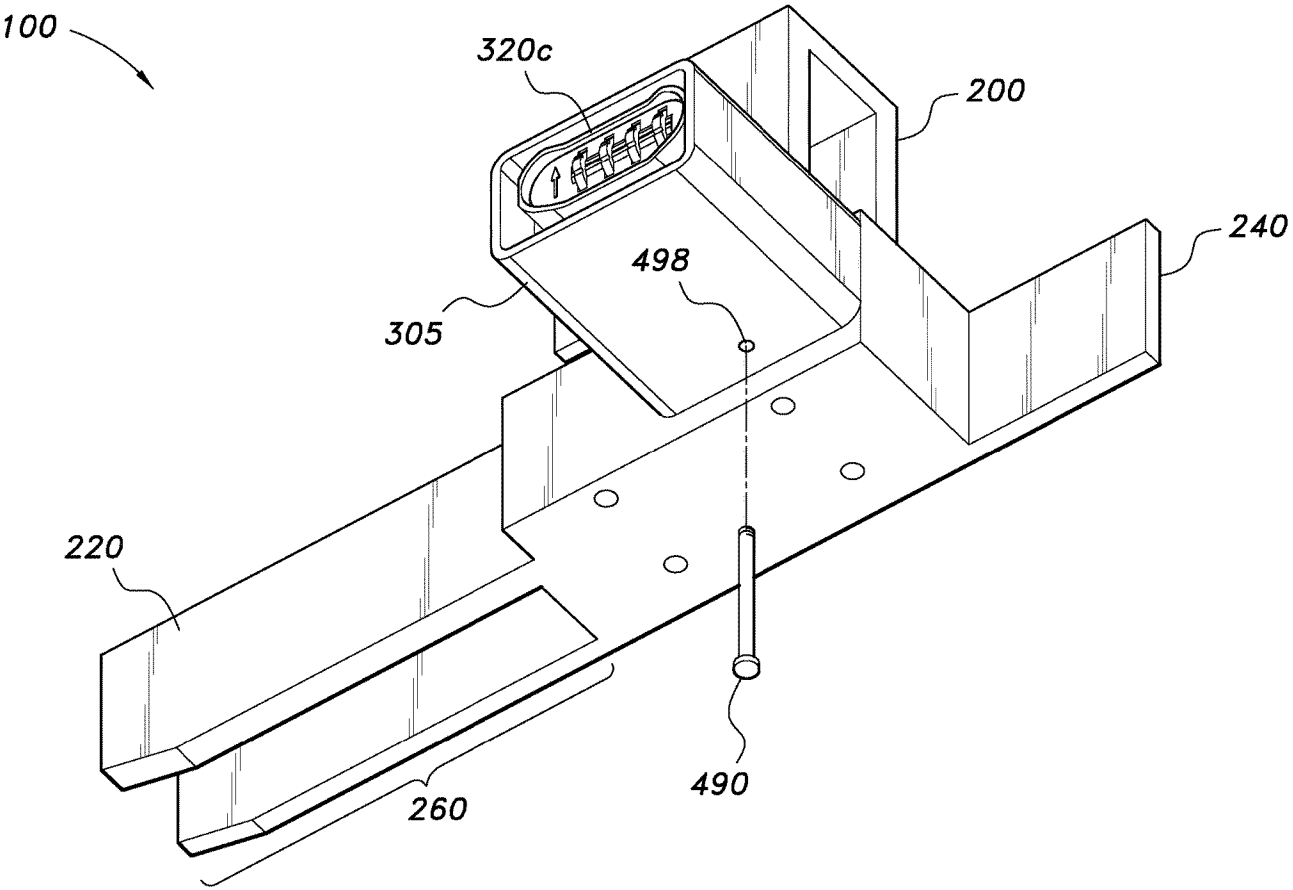
FIG. 4B is a perspective bottom view of the rolling door lock shown in FIG. 2A together with a securing member.
Figure 6:
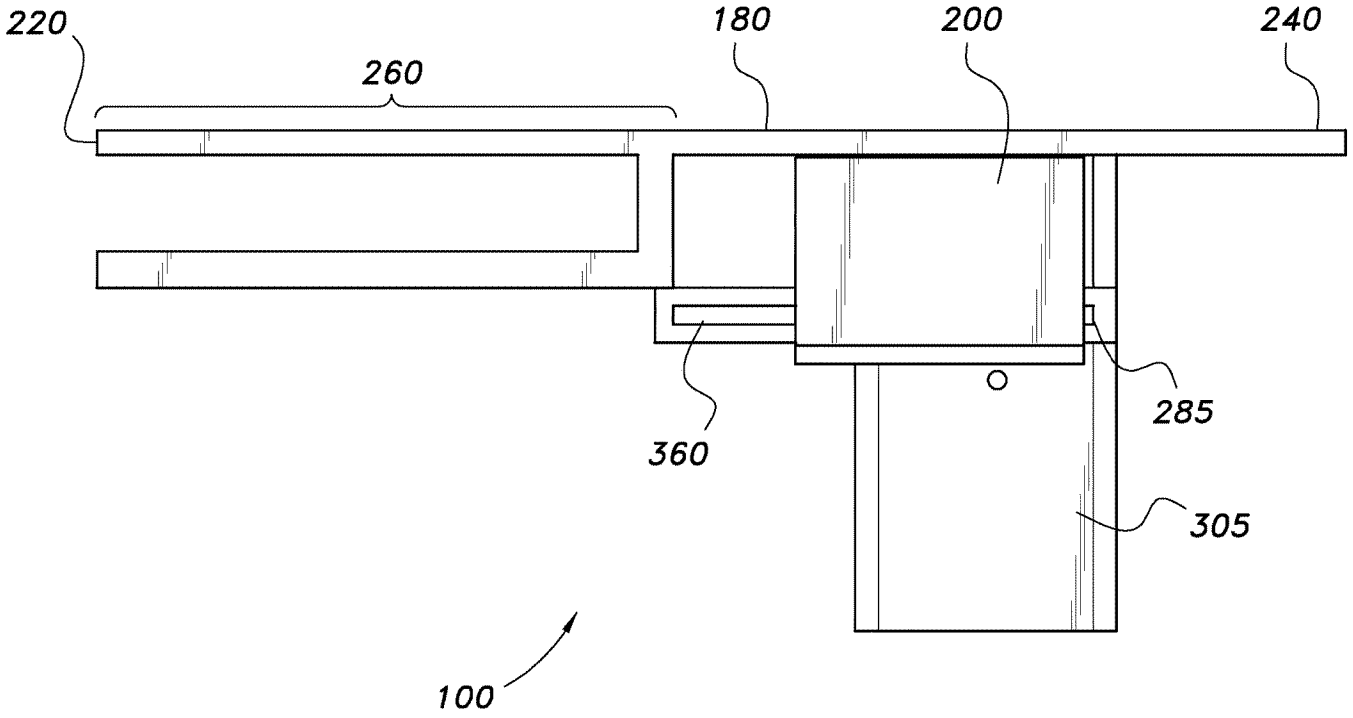
FIG. 6 is a top view of the rolling door lock of FIG. 2A.
Figure 7:
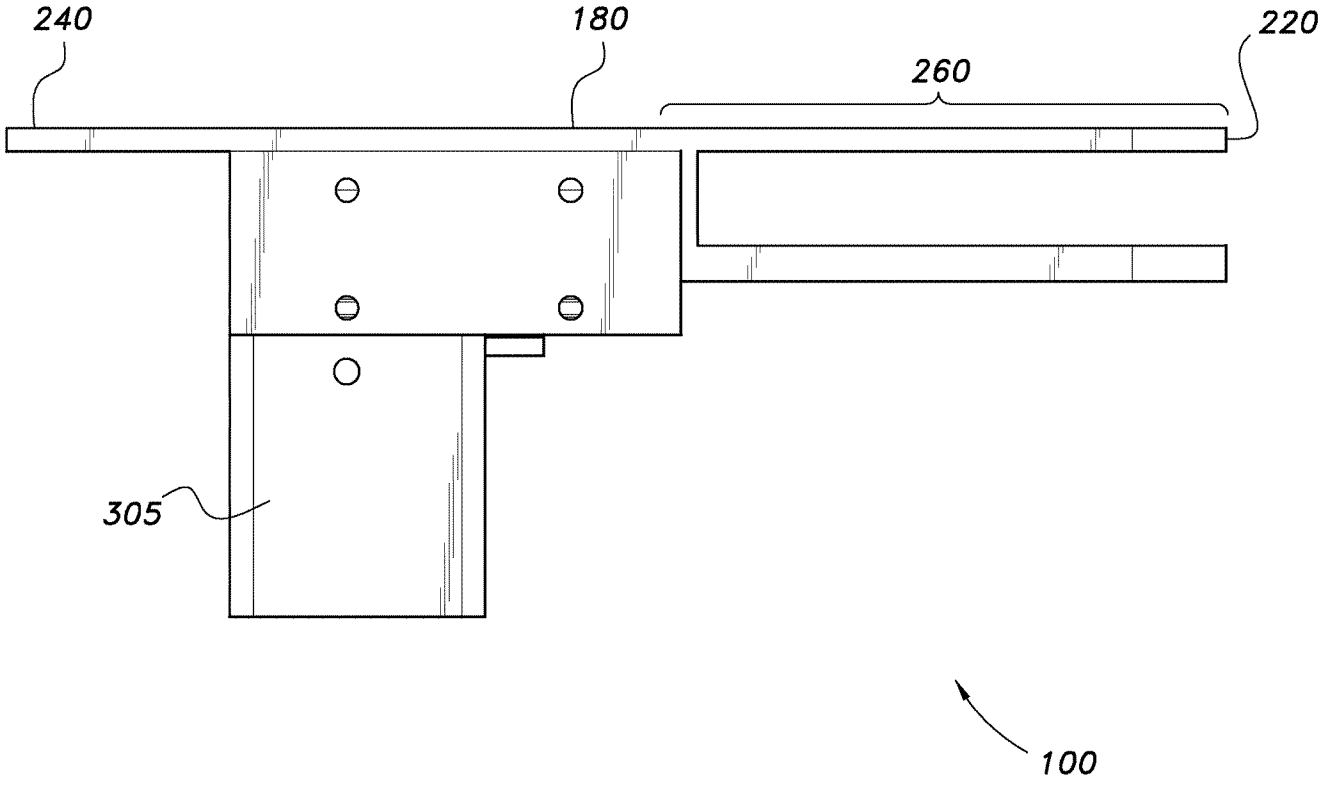
FIG. 7 is a bottom view of the rolling door lock of FIG. 2A.

FIGS. 4A and 4B include securing member 490. The securing member 490, such as a screw or bolt, also serves to hold the spring-loaded lock mechanism 330 in situ; for example, the securing member 490 holds the combination lock 320*c* in situ such as when the combination lock 320*c* is in an unlocked configuration. Securing member 490 can take the form of, for example, a screw or bolt. FIGS. 6 and 7 show top and bottom view of the rolling door lock 100.

Figure 5:
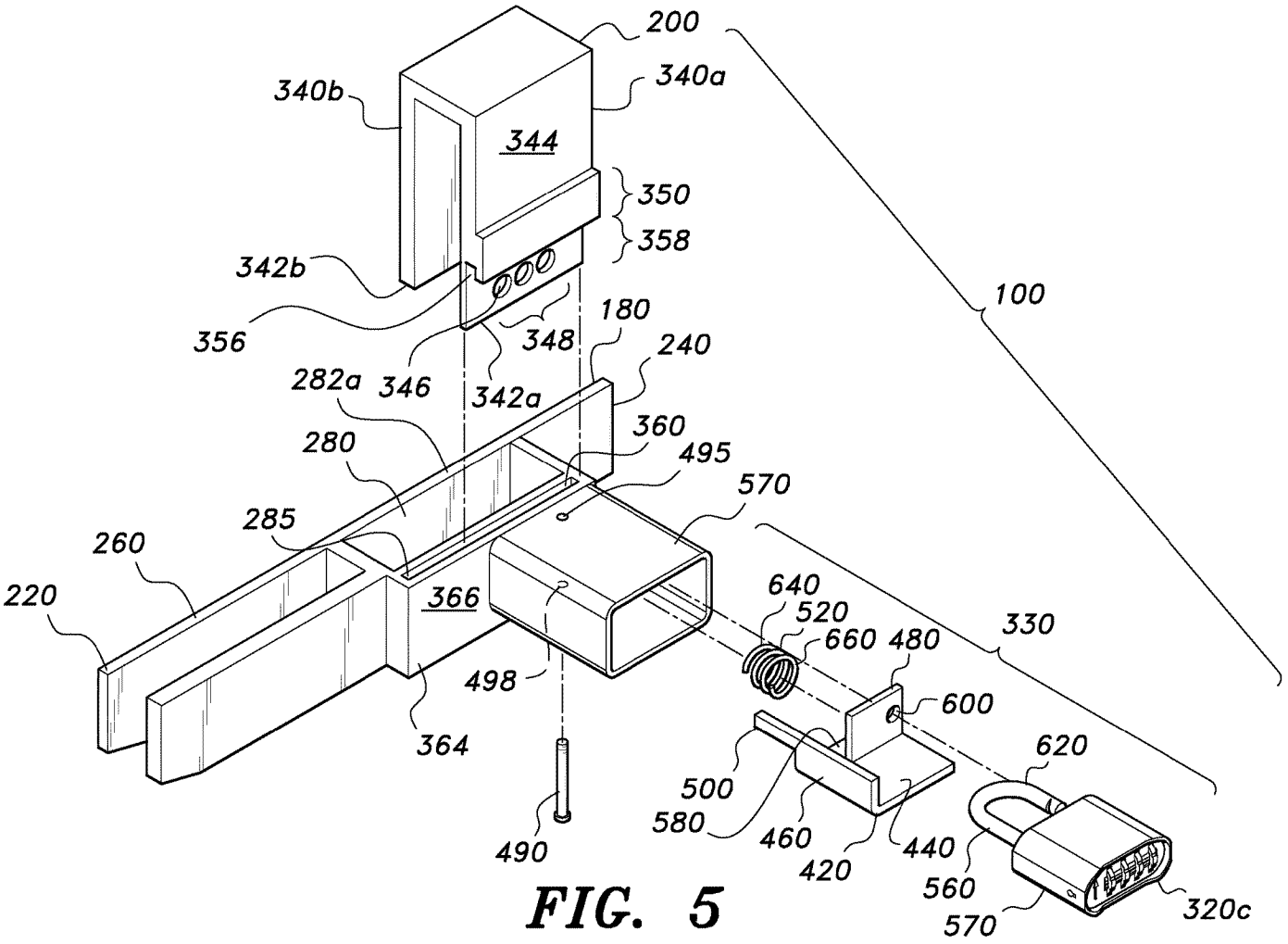
FIG. 5 is an exploded view of the rolling door lock of FIG. 2A.

Referring to FIG. 5, the detachable bracket 200 is a U-shaped bracket having first 340*a* and second 340*b* opposite sidewalls. The first sidewall 340*a* defines a first sidewall edge 342*a* and an exterior surface 344. The second sidewall 340*b* defines a second edge 342*b*. A plurality of holes 346 is arranged in a row of holes 348 proximate and parallel to the first edge 342*a* of the first wall 340*a* of the detachable bracket 200. An extension 350, which is integral with the outer surface 344 of the first wall 340*a*, is located above the row of holes 348. The first sidewall 340*a* and extension 350 cooperatively define a recess 354 in the form of a channel 356. The first side 340*a* of bracket 200 defines a lower portion 358. The lower portion 358 includes the row of holes 348. The lower portion 358 including the row of holes 348 is accommodated in slot 285. The penetration of the first side 340*a* into slot 285 is limited by contact between the channel 356 with the top 360 of slot 285.

Figure 8:
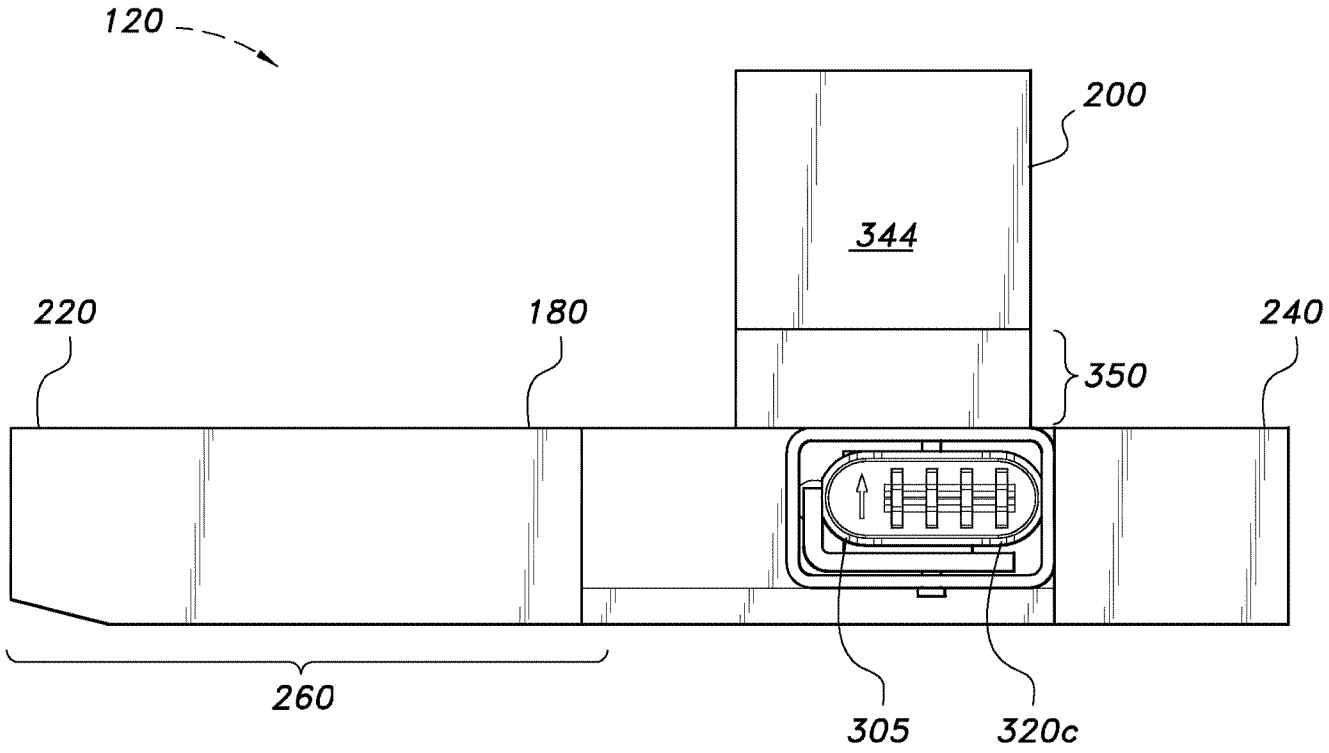
FIG. 8 is a front view of the rolling door lock of FIG. 2A.

The pocket (or slot) 280 includes slot 285. The slot 285 is defined by pocket (or slot) sidewall 282*b* and an outer slot sidewall 364. The outer sidewall 364 defines an exterior surface 366. The pocket (or slot) sidewall 282*b* and outer slot sidewall 364 have first and second slot holes 339*a* and 339*b* therethrough. The first slot hole 339*a* and the second slot hole 339*b* are aligned to allow a tongue 500 to pass into and out of the first and second aligned slot holes 339*a* and 339*b*. First and second slot holes 339*a* and 339*b* are shown in a section view in FIG. 10. Upon inserting detachable bracket 200 into pocket (or slot) 280, the detachable bracket 200 can be slid sideways in the pocket (or slot) 280 to align one of the plurality of holes 346 in the row of holes 348 to align with holes 339*a* and 339*b* to allow a tongue 500 to pass into one of the and out of the first and second aligned slot holes 339*a* and 339*b*. The pocket (or slot) 280 is sized to allow detachable bracket 200 to be moveable inside pocket (or slot) 280. In FIG. 8, the detachable bracket 200 is shown fitted to pocket (or slot) 280 (not visible in FIG. 8, but is shown in, for example, FIG. 5).

Figure 10:
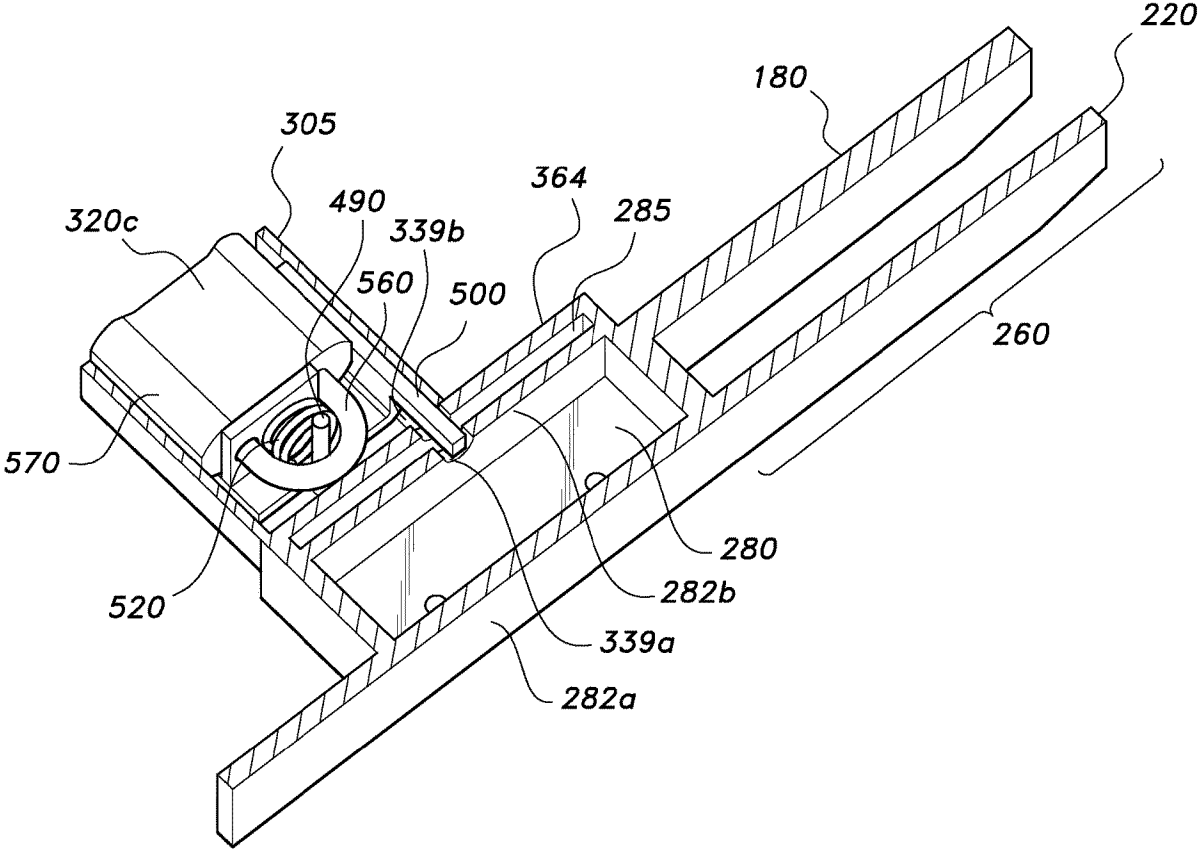
FIG. 10 is a perspective section view of the rolling door lock of FIG. 2A.

The lock mechanism 300 can take any suitable form such as a spring-loaded lock mechanism employing a lock such as, but not limited to, the combination lock 320*c* as shown, for example, in FIG. 10. The lock mechanism 300 can employ alternatives to a combination lock 320*c* such as a key operated lock 320*k* or a barrel shaped spring lock 320*b*. An example of a key operated barrel shaped spring lock is shown in FIG. 7 of U.S. Pat. No. 7,278,663 issued Oct. 9, 2007 to Witchey. The key operated barrel shaped spring lock is described, for example, in U.S. Pat. No. 6,553,797 issued Apr. 29, 2003 to Witchey (the barrel shaped spring lock is shown as part number 26 in U.S. Pat. No. 6,553,797). U.S. Pat. Nos. 6,553,797 and 7,278,663 are incorporated herein by reference in their entirety.

The spring-loaded lock mechanism 330 comprises an L-shaped bracket 420 having a first 440 and second 460 sidewalls; a base plate 480 attached to one end of the first sidewall 440 to create a second L-bracket with respect to first sidewall 440, a tongue 500 protruding from one end of second sidewall 460, a spring 520, and a combination lock 320*c*. The spring 520 having opposite ends 640 and 660. The combination lock 320*c* forms part of a spring-loaded lock mechanism 330. The combination lock 320*c* comprises a combination lock hook 560 and a combination lock housing 570. The spring-loaded lock mechanism 330 is housed inside lock housing 305. The tongue 500 is sized and positioned to move into and out of first and second slot holes 339*a* and 339*b* in the pocket (or slot) sidewall 282*b* and outer slot sidewall 364, and any of the plurality of holes 346 that are arranged in a row of holes 348 proximate and parallel to the first edge 342*a* of the first sidewall 340*a* of the detachable bracket 200.

It should be noted that the spring 520 could be left out depending on the ability of the lock hook 560 to spring back into an unlocked position. However, the spring 520 helps to control vibration within the lock mechanism 300; vibration occurs, for example, when a cargo truck is traveling on a road with potholes.

It should be understood that the exact configuration and position of the spring 520 can vary with respect to the lock hook 560. The spring 520 can be intertwined with the lock hook 560 (as shown in FIGS. 5A and 6A of U.S. Pat. No. 7,278,663), but preferably sits separately within the confines of the lock hook 560 (see FIGS. 5B and 6B in U.S. Pat. No. 7,278,663). One end of the spring 520 abuts against the base-plate 480 and the other end of the spring abuts against the securing member 490.

Base plate 480 and second sidewall 460 of bracket 420 defines a gap 580 therebetween. The base plate defines a hole 600 therein. The lock hook 560 defines lock hook end 620. During normal use, the lock hook end 620 fits through hole 600 in the base-plate 480. The purpose of hole 600 is to guide the lock hook end 620 of lock hook 560 back into the combination lock 320*c* as shown in FIG. 5 or, for example, key operated lock 320*k* (shown in FIG. 2B).

Spring end 640 of the spring 520 abuts against the exterior surface 366 of outer slot sidewall 364 and the other end 660 abuts against the base plate 480 to provide additional resilient force to operate the spring-loaded lock mechanism 330. However, the spring 520 is not absolutely necessary and may be left out particularly if, for example, the lock 320*c* or 320*k* have sufficient inbuilt resilient force to push out the lock hook 560. However, the spring 520 helps to control vibration within the lock mechanism 330. In one embodiment, at least part of the lock hook 560 fits through the spring 520.

The component parts of the spring-loaded lock mechanism 330 are housed inside lock housing 305. The securing member 490, such as a screw or bolt, also serves to hold the spring-loaded lock mechanism 330 in situ; for example, the securing member 490 holds the combination lock 320*c* in situ such as when the combination lock 320*c* is in an unlocked configuration; the member 490 also prevents unauthorized removal of combination lock 320*c* from housing 305. The securing member 490 fits through a securing hole 495 in one side of the lock housing 305; an optional blind hole 498 on the other side of the lock housing 305 secures the securing member 490, thereby preventing unauthorized removal of the lock mechanism 330.

The combination number of the combination lock 320*c* is optionally changeable to a new locking/unlocking combination. This feature is useful, for example, when an employee leaves or if the combination number becomes generally known. In addition, the combination lock 320*c* could be swapped out and replaced with another combination lock or, for example, a key operated barrel shaped spring lock as shown in FIG. 7 of U.S. Pat. No. 7,278,663 issued Oct. 9, 2007 to Witchey. The key operated barrel shaped spring lock is described, for example, in U.S. Pat. No. 6,553,797 issued Apr. 29, 2003 to Witchey (the barrel shaped spring lock is shown as part number 26 in U.S. Pat. No. 6,553,797). U.S. Pat. Nos. 6,553,797 and 7,278,663 are incorporated herein by reference in their entirety.

With reference to a latching handle assembly 120 fitted to a roll-up door 160 where the hook 130 is typically on the left as viewed looking towards the exterior surface 140 of the roll-up door 160, an optimum way to secure the latching handle assembly 120 is by: (i) rolling down the roll-up door 160; (ii) using the latching handle assembly 120 to secure the roll-up door 160; (iii) positioning the hook securing portion 260 such that the hook 130 is positioned well inside the hook securing portion 260 of the main body 180; (iv) positioning the detachable bracket 200 over a portion of the handle 125 of latching handle assembly 120; (v) sliding the detachable bracket 200 (with a portion of the handle 125 positioned therein) in a direction towards the end 127 of the handle 125 (see FIG. 11); and (vi) using the spring-loaded lock mechanism 330, and the tongue 500 therein, to secure the detachable bracket 200 (with a portion of the handle 125 positioned therein) inside the pocket (or slot) 280.

A significant advantage of the rolling door lock 100 of the present invention is that it can be used synergistically in combination with a padlock 368 to secure a latching handle assembly 120. For example, if a padlock 368 is already installed to secure a latching handle assembly 120 (see FIG. 11), the rolling door lock 100 works cooperatively with the separate padlock 368 to further prevent misuse of a latching handle assembly 120. The operator, such as a truck driver, can tilt the separate padlock in a direction away from the hook 130 of latching handle assembly 120 to create enough room to insert the detachable bracket 200 (with a portion of the handle 125 positioned therein) into pocket (or slot) 280.

Figure 12:
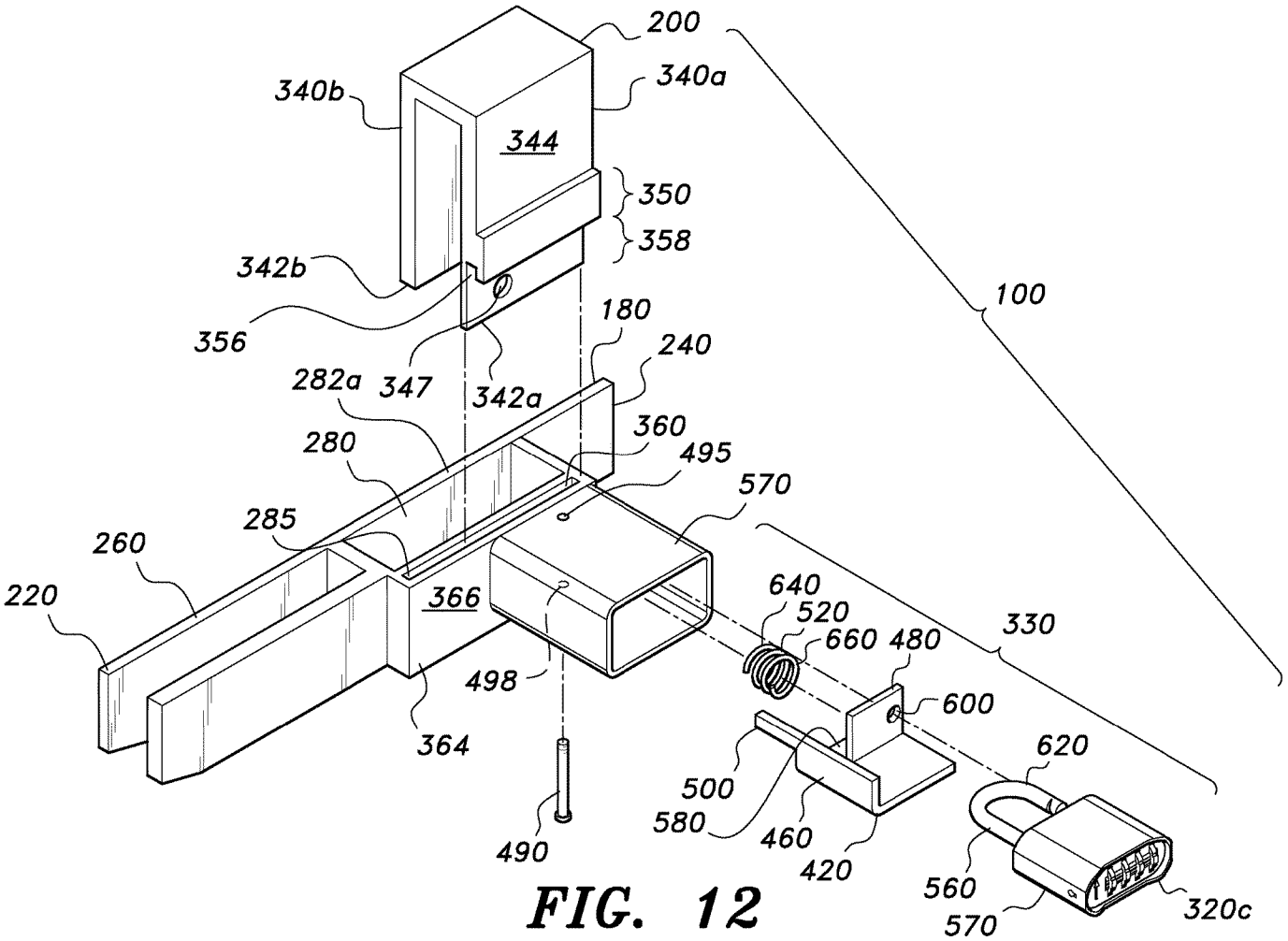
FIG. 12 is an exploded view of a rolling door lock according to the present invention.

FIG. 12 shows an embodiment in which the row of holes 348 is replaced by a single hole 347.

It is to be understood that the present invention is not limited to the embodiments described above, but encompasses any and all embodiments within the scope of the following claims.

What is claimed:

1. A rolling door lock for securing a roll-up door, the roll-up door having a latching handle assembly fitted to an exterior surface of the roll-up door, the latching handle assembly having a handle and a hook, said rolling door lock comprising:

a main body;

a detachable bracket, having a tab on a bottom thereof;

wherein the main body has opposite first and second ends, a hook securing portion at the first end, and a slot, opening toward a top of the main body, for receiving the tab on the detachable bracket, wherein the hook securing portion forms the first end of the main body, the slot is located between the hook securing portion and the second end of the main body;

a lock mechanism that is attached to the slot, wherein the lock mechanism comprises a lock and a tongue held in place by the lock wherein the lock mechanism secures the detachable bracket to the slot, and wherein during normal use, the hook securing portion secures the hook of a latching handle assembly having a handle, the detachable bracket securing the handle, and the lock mechanism locking the detachable bracket with the handle by securing the tab of the detachable bracket to the slot of the main body, wherein the slot of the main body and the tab of the detachable bracket have respective alignable holes, through which a tongue of the lock mechanism secures the main body and detachable bracket wherein the lock mechanism is disposed entirely within a lock housing connected to the second end of the main body.

2. The rolling door lock of claim 1, wherein said lock mechanism is a spring-loaded lock mechanism.

3. The rolling door lock of claim 2, wherein said spring-loaded lock mechanism comprises a spring-loaded combination lock.

4. The rolling door lock of claim 2, wherein said spring-loaded lock mechanism comprises a combination lock.

5. The rolling door lock of claim 4, wherein said combination lock is held in situ by a securing member.

6. The rolling door lock of claim 2, wherein said spring-loaded lock mechanism comprises a barrel shaped spring lock.

7. The rolling door lock of claim 2, wherein said spring-loaded lock mechanism is held in situ by a securing member.

8. The rolling door lock of claim 1, wherein said lock mechanism comprises a key operated lock.

9. The rolling door lock of claim 1, wherein said detachable bracket is a U-shaped bracket.

10. A rolling door lock for securing a roll-up door, the roll-up door having a latching handle assembly fitted to an exterior surface of the roll-up door, the latching handle assembly having a handle and a hook, said roll-up door lock comprising:

a main body;

a detachable bracket having a tab on a bottom thereof;

wherein the detachable bracket comprises first and second opposite sidewalls, the first sidewall defines a first sidewall edge and an exterior surface of the first sidewall, the first sidewall defining the tab, wherein, the detachable bracket comprises a plurality of holes arranged in a row of holes proximate and parallel to the first edge of the first wall of the detachable bracket, and disposed on the tab, wherein the detachable bracket comprises an extension, which is integral with the exterior surface of the first sidewall, is located above the row of holes, the first sidewall and extension cooperatively define a recess in the form of a channel, wherein the main body has opposite first and second ends, a hook securing portion at the first end, and a slot, opening toward a top of the main body, for receiving the tab on the detachable bracket, wherein the slot includes a portion engageable with the channel of the detachable bracket, the slot having a second plurality of holes arranged to be aligned with the holes of the tab, and disposed on the slot, and wherein the hook securing portion forms the first end of the main body, the slot being located between the hook securing portion and the second end of the main body; and a lock mechanism that is attached to the slot, wherein the lock mechanism comprises a lock and a tongue held in place by the lock, wherein the lock mechanism secures the detachable bracket to the slot, and wherein during normal use of the rolling door lock, the hook securing portion secures the hook of a latching handle assembly having a handle, the detachable bracket secures the handle, and the lock mechanism locks the detachable bracket with the handle secured therein to the pocket, wherein holes of the slot of the main body and the holes of the tab of the detachable bracket are alignable so that a tongue of the lock mechanism secures the main body and detachable bracket wherein the lock mechanism is disposed entirely within a lock housing connected to the second end of the main body.

11. The rolling door lock of claim 10, wherein said detachable bracket is a U-shaped bracket.

12. The rolling door lock of claim 10, wherein the slot is defined by the second pocket sidewall and an outer slot sidewall, the second pocket sidewall and outer slot sidewall have first and second slot holes therethrough, wherein the lock mechanism comprises a spring-loaded lock mechanism having a tongue, wherein upon securing said detachable bracket to said pocket the tongue travels through the first and second slot holes.

13. The rolling door lock of claim 10, wherein said lock mechanism is a spring-loaded lock mechanism.

14. The rolling door lock of claim 13, wherein said lock mechanism comprises a spring-loaded combination lock.

15. The rolling door lock of claim 13, wherein said spring-loaded lock mechanism comprises a combination lock.

16. The rolling door lock of claim 15, wherein said combination lock is held in situ by a securing member.

17. The rolling door lock of claim 13, wherein said spring-loaded lock mechanism comprises a barrel shaped spring lock.

18. The rolling door lock of claim 13, wherein said spring-loaded lock mechanism is held in situ by a securing member.

19. The rolling door lock of claim 10, wherein said lock mechanism comprises a key operated lock.

20. A rolling door lock for securing a roll-up door, the roll-up door having a latching handle assembly fitted to an exterior surface of the roll-up door, the latching handle assembly having a handle and a hook, said roll-up door lock comprising:

a main body;

a detachable bracket having a tab on a bottom thereof;

wherein the detachable bracket comprises first and second opposite sidewalls, the first sidewall defines a first sidewall edge and an exterior surface of the first sidewall, the first sidewall defining the tab, wherein, the detachable bracket comprises a single hole proximate to the first edge of the first wall of the detachable bracket, and disposed on the tab, wherein the detachable bracket comprises an extension, which is integral with the exterior surface of the first sidewall, is located above the single hole of the detachable bracket, the first sidewall and extension cooperatively define a recess in the form of a channel, wherein the main body has opposite first and second ends, a hook securing portion at the first end, and a slot, opening toward a top of the main body, for receiving the tab on the detachable bracket, wherein the slot includes a portion engagable with the channel of the detachable bracket, the slot having a second hole alignable with the first hole of the tab, and disposed on the slot, and wherein the hook securing portion forms the first end of the main body, the slot being located between the hook securing portion and the second end of the main body; and a lock mechanism that is attached to the slot, wherein the lock mechanism comprises a lock and a tongue held in place by the lock wherein the lock mechanism secures the detachable bracket to the slot, and wherein during normal use of the rolling door lock, the hook securing portion secures the hook of a latching handle assembly, the detachable bracket secures the handle, and the lock mechanism locks the detachable bracket with the handle secured therein to the pocket, wherein hole of the slot of the main body and the hole of the tab of the detachable bracket are alignable so that a tongue of the lock mechanism secures the main body and detachable bracket wherein the lock mechanism is disposed entirely within a lock housing connected to the second end of the main body.

* * * * *